US006276177B1

(12) United States Patent
West

(10) Patent No.: US 6,276,177 B1
(45) Date of Patent: Aug. 21, 2001

(54) KNITTED ELASTOMERIC FABRIC

(75) Inventor: Roger Donald West, Madison, VA (US)

(73) Assignee: Liberty Fabrics, Gordonsville, VA (US)

( * ) Notice: Subject to any disclaimer, the term of this patent is extended or adjusted under 35 U.S.C. 154(b) by 0 days.

(21) Appl. No.: 09/389,472

(22) Filed: Sep. 3, 1999

(51) Int. Cl.[7] ..... D04B 23/06

(52) U.S. Cl. ..... 66/192; 66/195; 66/202; 442/306

(58) Field of Search ..... 66/190, 191, 192, 66/195, 202, 172 E, 84 R, 85 R, 203; 442/306, 312, 314

(56) References Cited

U.S. PATENT DOCUMENTS 2,411,175 * 11/1946 Wagler ..... 66/192
4,015,451 * 4/1977 Gajjar ..... 66/195
4,074,543 * 2/1978 Schmidt ..... 66/193
4,103,485 * 8/1978 Brues ..... 66/192
4,248,064 * 2/1981 Odham ..... 66/192
4,280,259 * 7/1981 Bassist ..... 28/160
4,527,404 * 7/1985 Nakagaki et al. ..... 66/202
4,748,078 * 5/1988 Doi et al. ..... 442/312
5,172,570 * 12/1992 Wade et al. ..... 66/195
5,522,240 * 6/1996 Wall et al. ..... 66/192

FOREIGN PATENT DOCUMENTS

3006194 * 9/1980 (DE) ..... 66/192

* cited by examiner

*Primary Examiner*—Danny Worrell
(74) *Attorney, Agent, or Firm*—Kenyon & Kenyon

(57) ABSTRACT

A knitted elastomeric fabric according to the present invention includes a ground yarn, a laterally laid in yarn laid into the ground yarn and at least two elastomeric yarns laid into the ground yarn. One of the elastomeric yarns is laid into the ground yarn to form, along with the laterally laid in yarn, a base elastomeric fabric. The second elastomeric yarn is laid into the ground yarn so that at least the ground yarn, the laterally laid in yarn, and the pattern elastomeric yarn form a pattern elastomeric zone, wherein the pattern elastomeric zone and base elastomeric fabric have differing elastomeric properties. A knitted elastomeric fabric according to the present invention may also include additional yarns. For example, the fabric may include an inlaid Jacquard or lace yarn creating a lace pattern. In addition or alternatively, the fabric may include one or more yarns to create a secure edge to minimize unstitching where fabric must be separated by cutting or one or more pattern yarns laid in, for example, by pattern bars to form inlays or other patterns.

28 Claims, 8 Drawing Sheets

KNITTED ELASTOMERIC FABRIC

FIELD OF THE INVENTION

The present invention relates to the knitted fabrics, and in particular knitted elastomeric fabrics.

BACKGROUND INFORMATION

Elastomeric fabrics have wide-ranging uses. For example, many lace or Jacquard elastomeric fabrics are used to form undergarments and other clothing. Typically elastomeric knitted fabrics are formed on warp knitting machines to predetermined widths and repeats. Once formed, these fabrics may be cut into the correct shapes as required for manufacture and then sewn together.

Many products which incorporate elastomeric fabrics require additional or supplemental materials to provide greater strength or support in certain areas. For example, undergarments often include an additional band of fabric applied to the waist edge to hold the garment in position, or for example include sewn-in underwires to provide support. In this case, construction of the garment or other product requires additional manufacturing steps and materials, increasing costs. Moreover, the stitching and seams formed by the additional materials may decrease the comfort of the garment or product or detract from its appearance.

SUMMARY OF THE INVENTION

A knitted elastomeric fabric according to the present invention includes a knitted ground yarn, a laterally laid in yarn, and at least two elastomeric yarns laid into the ground yarn. One of the elastomeric yarns, referred to herein as a base elastomeric yarn, is laid into the ground yarn to form, along with the laterally laid in yarn, a base elastomeric fabric. The second elastomeric yarn, referred to here as a pattern elastomeric yarn, is laid into the ground yarn so that the ground yarn, the laterally laid in yarn, and the pattern elastomeric yarn (and if suitable the base elastomeric yarn) form a pattern elastomeric zone, wherein the pattern elastomeric zone and base elastomeric fabric have differing elastomeric properties. Additional elastomeric yarns may also be utilized to create additional elastomeric zones.

A knitted elastomeric fabric according to the present invention may also include additional yarns. For example, the fabric may include an inlaid Jacquard or lace yarn creating a lace pattern. In addition or alternatively, the fabric may include one or more yarns referred to herein as "securing yarns." These may create a secure edge to minimize unstitching where fabric must be separated by cutting. Other yarns may also be laid in to form, for example, patterns and inlays if desired.

DETAILED DESCRIPTION

A knitted elastomeric pattern according to the present invention incorporates one or more elastic yarns, in addition to the yarn forming the base elastomeric structure of the fabric, to provide at least one elastomeric zone having different elastomeric properties than the base structure. In this manner, additional supporting elastomeric bands or wires are not necessary, increasing the comfort of the fabric, for example, while decreasing costs of production. A fabric according to the present invention may be constructed on a warp knitting machine, and in particular such a machine capable of forming a Jacquard pattern.

Figure 1:
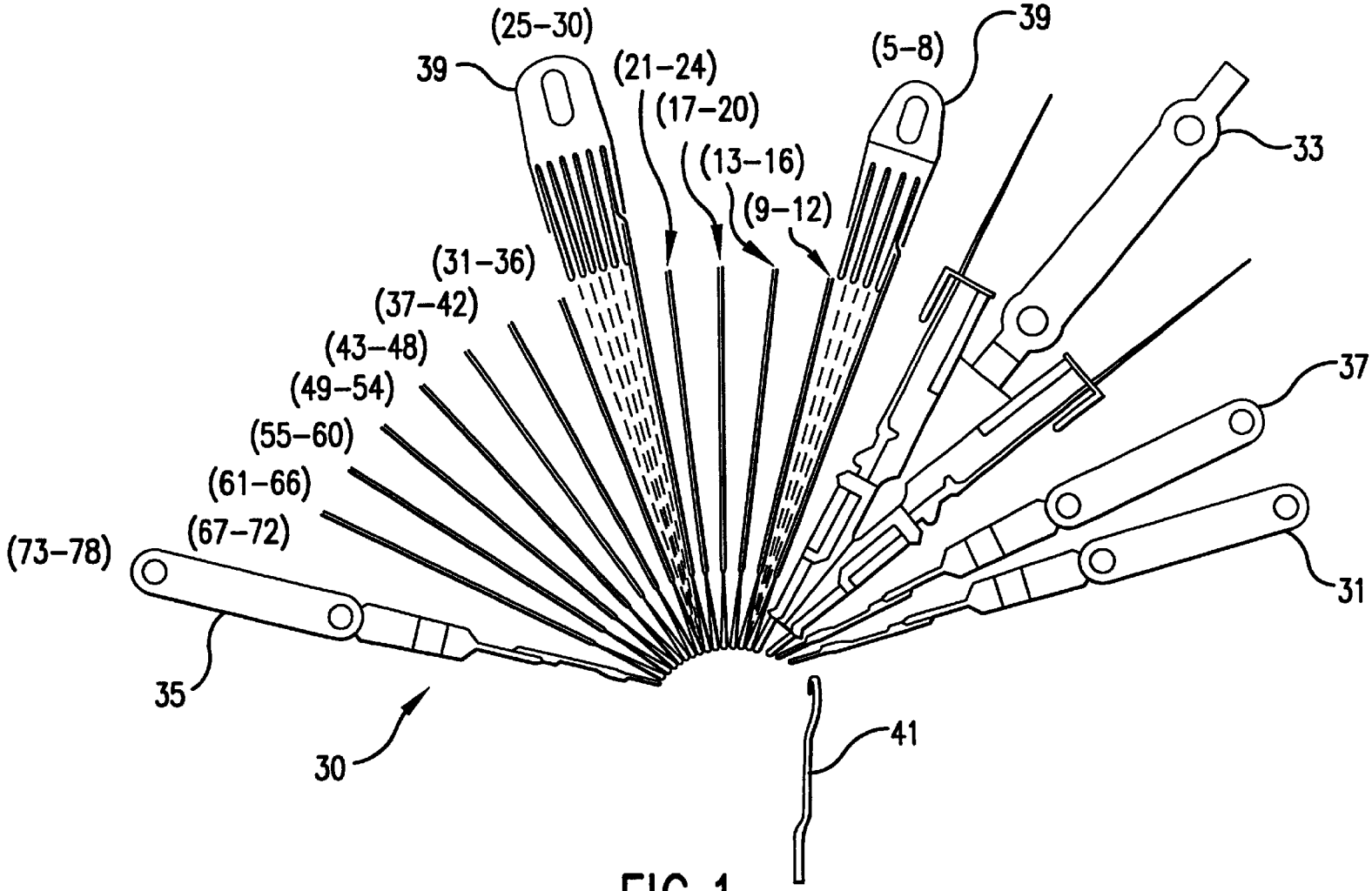
FIG. 1 is a schematic side view of a warp knitting machine for producing elastomeric fabric.

FIG. 1 illustrates an exemplary warp knitting machine 30 used in the art to construct a basic elastomeric fabric. This exemplary warp knitting machine 30 may be a Karl-Mayer warp knitting machine, for example of the type MRSJ 78/1 SUL having 78 bar positions. In the illustrated configuration, the warp knitting machine 30 includes a solid bar referred to herein as base bar 31, which is present in the first bar position (denoted where appropriate by parenthetical numbers). Base bar 31 is used to knit in a yarn to form the base structure of the fabric. Warp knitting machine 30 also includes a Jacquard bar 33 for laying in a Jacquard yarn in a desired pattern. In addition, warp knitting machine 30 includes a solid back bar at position (73), referred to as a first back bar 35, for laying in an elastomeric fabric to provide the basic elastomeric structure to the fabric. Each of the bars works in conjunction with needle 41 to form the fabric.

In the warp knitting machine 30 of FIG. 1, a solid bar is also provided in the second bar position, referred to herein as a securing bar 37. Securing bar 37 can be utilized to knit in a first "securing yarn," which when present provides a secure edge if fabric must eventually be cut. A second securing bar 37 (not shown) may also be provided. Warp knitting machine 30 may also include one or more pattern bars 39 at positions (5) to (72).

Figure 2:
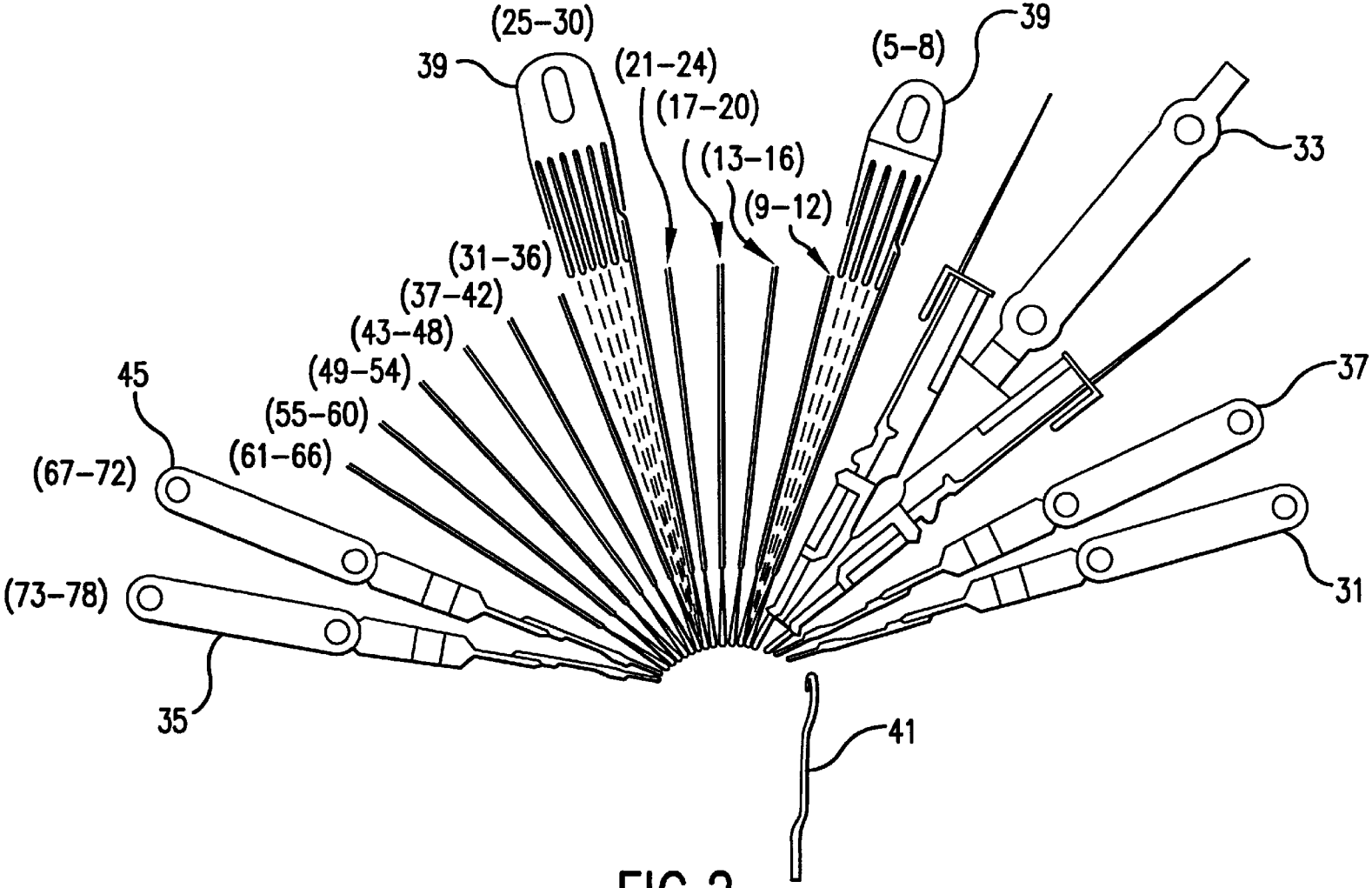
FIG. 2 is a schematic side view of an exemplary warp knitting machine for producing a fabric according to the present invention.

FIG. 2 illustrates an exemplary warp knitting machine 30 capable of producing an elastomeric fabric according to the present invention. In this configuration, warp knitting machine 30 includes an additional solid bar inserted in a position normally reserved for pattern bars. In particular, in the exemplary arrangement of FIG. 2 a solid bar, referred to herein as a second back bar 45, is provided which allows a "pattern" elastomeric yarn to be laid into the fabric to form a "pattern elastomeric zone." The solid second back bar 45 is preferably utilized, because such a solid bar is capable of laying in an elastomeric yarn without unduly flexing or bending. Additional solid back bars (not shown) may also be provided to lay in additional elastomeric yarns, if desired. Likewise, any suitable number of pattern bars may be provided to lay in any additional suitable yarns.

The illustrated warp knitting machine 30 of FIG. 2 is a Karl-Mayer warp knitting machine of the type MRSJ 78/1 SUL having up to 78 bar positions. The illustrated warp knitting machine 30 includes a Jacquard bar 33, and is therefore capable of creating a Jacquard pattern, where desired. In addition, at least the second back bar 45 of this exemplary machine 30 is preferably computer-driven, allowing for lateral movement up to 47 needles (in the illustrated configuration) as well as for extremely long pattern repeats.

A fabric according to the present invention may be constructed on other warp knitting machines 30, for example (but not limited to) Karl-Mayer machine types MRE 30/24 SUL, MRSJF 31/1/24, MRE 32/24 SUL, MRSS 42 SUL, MRSJ 43/1 SUL, MRSJF 53/1/24, MRSJF 56/1 SUL, and MRSJ 78/1 SUL. A warp knitting machine 30 for use in conjunction with the present invention may or may not be computer driven, include a Jacquard bar 33, include one or more securing bars 37, or include one or more pattern bars 39. To construct the exemplary fabric discussed below, however, warp knitting machine 30 preferably includes a Jacquard bar 33 and at least one securing bar 37.

Figure 3:
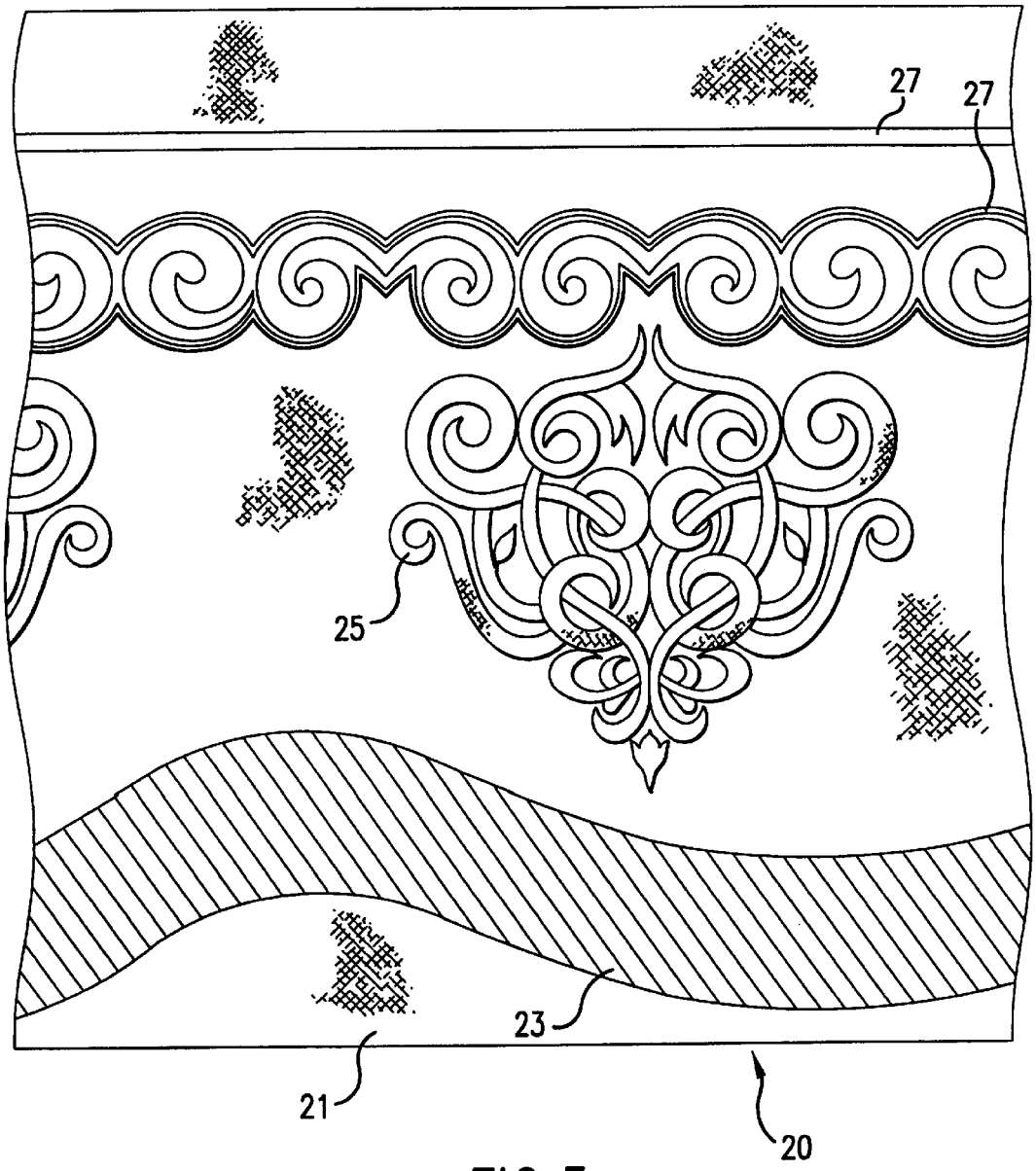
FIG. 3 is an illustration of an exemplary fabric according to the present invention.

FIG. 3 illustrates an exemplary elastomeric fabric 20 according to the present invention. Fabric 20 may be formed, for example, on the preferred warp knitting machine 30 described above. In this embodiment, elastomeric fabric 20 includes a "base elastomeric fabric" 21 which forms the base structure of the fabric, along with a "pattern elastomeric zone" 23 having different elastomeric properties than base elastomeric fabric 21. For example, pattern elastomeric zone 23 may be constructed to provide an area of increased strength or elasticity, thereby providing additional support in the resulting product. Formation of the base elastomeric fabric 21 and pattern elastomeric zone 23 is discussed in detail below. In addition, the elastomeric fabric 20 of FIG. 3 includes a Jacquard pattern 25 laid into the fabric, as well as, for example, two securing edges 27, which minimize unraveling of fabric 20 when cut along either securing edge 27.

An elastomeric fabric 20 according to the present invention may be formed using any suitable yarns incorporated according to any suitable stitch pattern. Preferably, however, a fabric 20 according to the present invention is formed using a "ground" yarn, a "laterally laid in yarn," a "base elastomeric yarn," and a "pattern elastomeric yarn." Fabric 20 may also include a Jacquard yarn as well as one or more "securing yarns." Preferably, the ground yarn is knitted in by base bar 31, while the base elastomeric yarn is laid in by first back bar 35 and the pattern elastomeric yarn is laid in by second back bar 45. As noted above, additional pattern elastomeric yarns may be laid in by additional bars 45. In the illustrated embodiment described herein, the laterally laid in yarn is a Jacquard yarn (and for convenience may be referred to herein as simply a Jacquard yarn) laid in by Jacquard bar 33. In general, the laterally laid in yarn may be any suitable yarn laid into the ground yarn in any suitable manner, as understood in the art. For example, many preferred fabrics according to the present invention may utilize the laterally laid in yarn to form inlays or other patterns. Any securing yarns may be knitted in by one or more securing bars 37.

In a fabric 20 according to the present invention, the base elastomeric yarn, then laterally laid in yarn, and the ground yarn form base elastomeric fabric 21, although it is understood that the laterally laid in yarn might not be present throughout the entire base elastomeric fabric 21. Likewise, where the pattern elastomeric yarn is laid into the ground yarn, those yarns as well as the pattern elastomeric yarn form pattern elastomeric zone 23, so that the base elastomeric fabric 21 and pattern elastomeric zone 23 have differing elastomeric properties (where again it is understood that the laterally laid in yarn may be present through part or none of any particular pattern elastomeric zone 23). In some cases, for example where pattern elastomeric zone 23 is formed along a straight line (such as to form a waistband), first back bar 35 need not be fully threaded, so that the base elastomeric yarn is not present where the pattern elastomeric yarn is laid in. In this case, only the ground yarn, laterally laid in yarn, and pattern elastomeric yarn form the pattern elastomeric zone 23.

While any suitable yarns may be used to construct an elastomeric fabric 20 according to the present invention, in a preferred embodiment the ground yarn is a multi-filament synthetic yarn of between approximately 10 and approximately 100 denier, the base elastomeric yarn is a continuous filament elastic yarn of between approximately 40 and approximately 400 denier, the pattern elastomeric yarn is a continuous filament elastic yarn of at least approximately 100 denier, and the laterally laid in yarn or Jacquard yarn is a multi-filament synthetic yarn of between approximately 10 and approximately 100 denier. If one or more securing yarns are utilized, a preferred securing yarn is a synthetic yarn of between approximately 20 and approximately 150 denier.

Even more particularly, in a preferred embodiment of a fabric 20 according to the present invention, the ground yarn is a multi-filament synthetic yarn of between approximately 30 and approximately 50 denier and having between approximately 10 and approximately 50 filaments, the base elastomeric yarn is a continuous filament elastic yarn of between approximately 120 and approximately 160 denier, the pattern elastomeric yarn is a continuous filament elastic yarn of at least approximately 120 denier, and the laterally laid in yarn is a Jacquard yarn, preferably a multi-filament synthetic yarn of between approximately 30 and approximately 50 denier and having between approximately 10 and approximately 50 filaments. If one or more securing yarns are utilized, the securing yarn is preferably a synthetic yarn of between approximately 40 and approximately 60 denier. If additional back bars 45 are present and if these bars lay in additional pattern elastomeric yarns, then preferred embodiments for these yarns are similar to the preferred pattern elastic yarns described above. Moreover, any suitable number of pattern bars may be present to lay in additional yarns, which may be of any suitable material, denier, or number of filaments.

Figure 4:
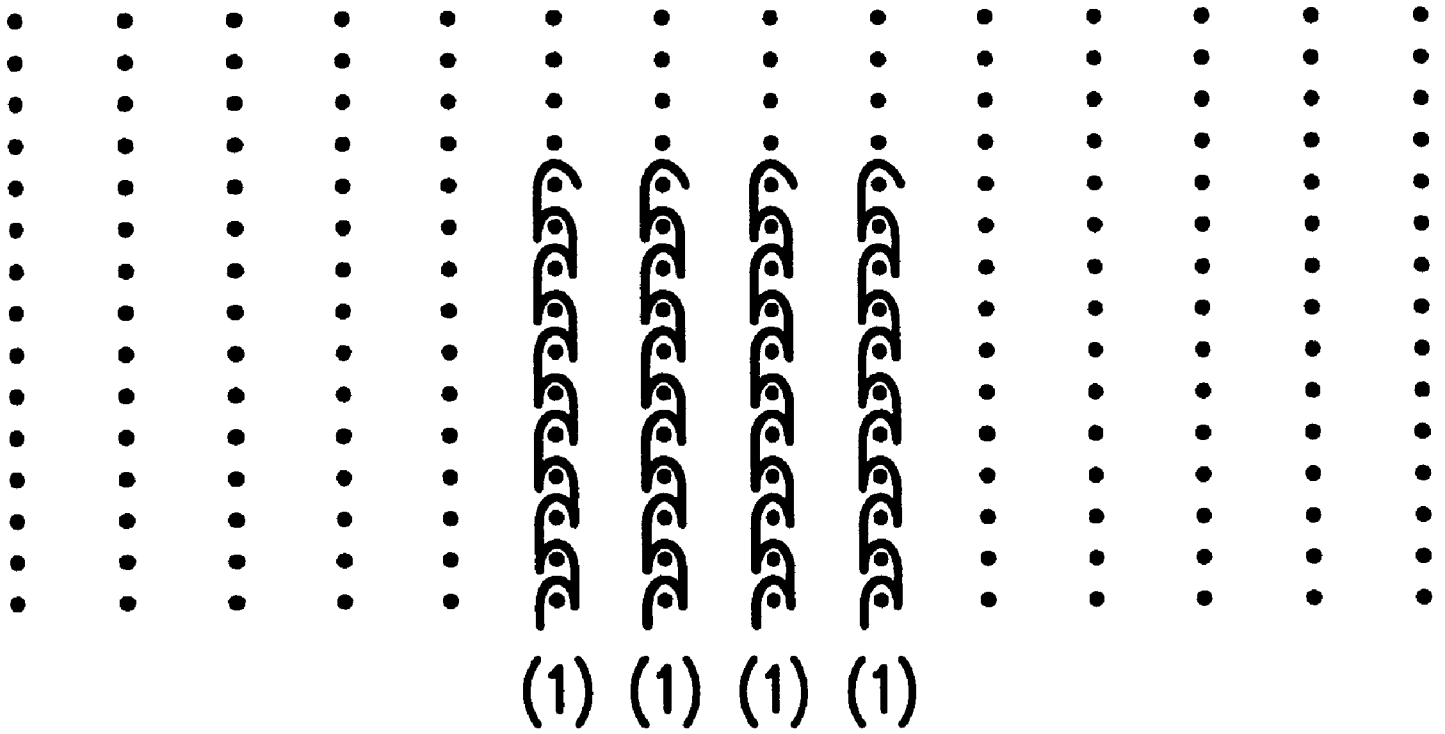
FIG. 4 is an exemplary stitch diagram for one yarn of an exemplary fabric according to the present invention.
Figure 5:
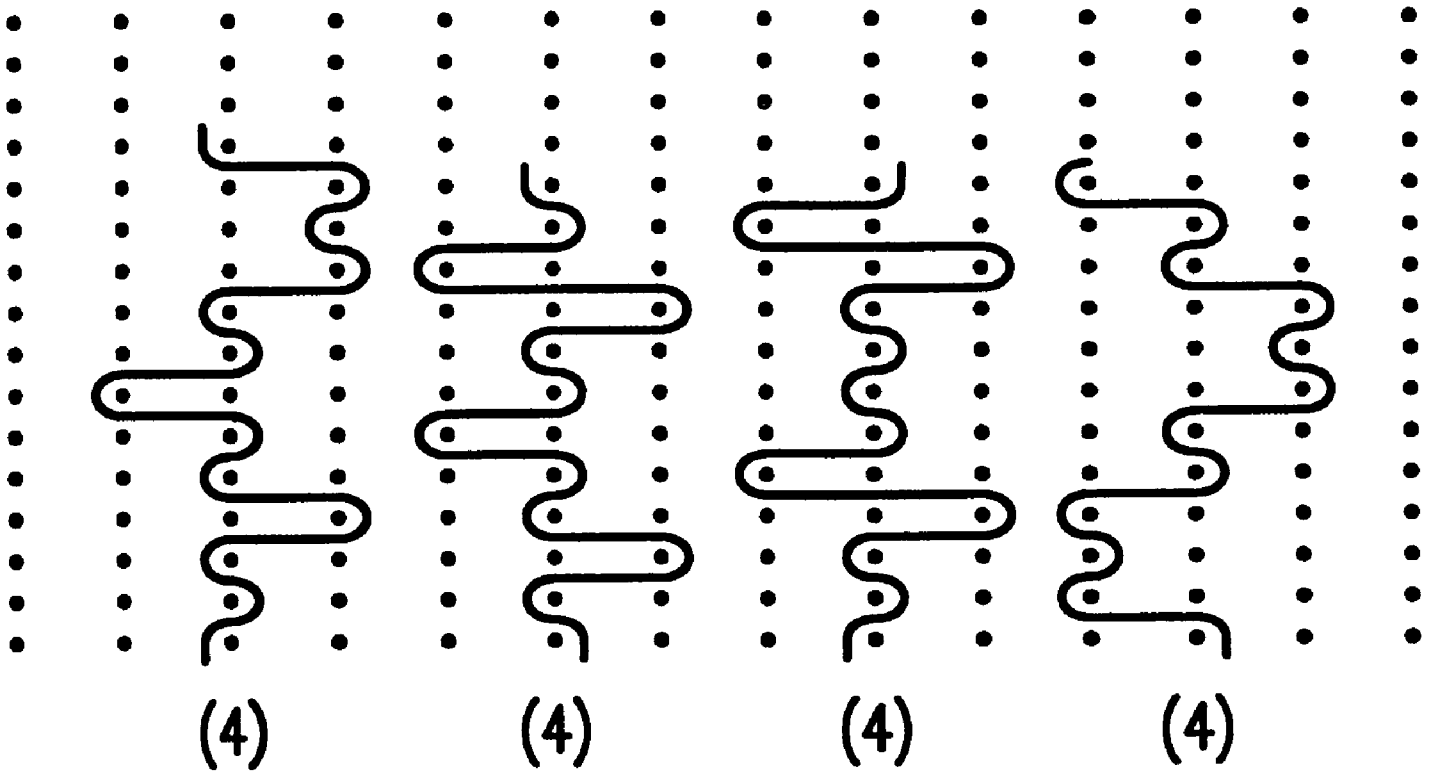
FIG. 5 is an exemplary stitch diagram for a second yarn of an exemplary fabric according to the present invention.
Figure 6:
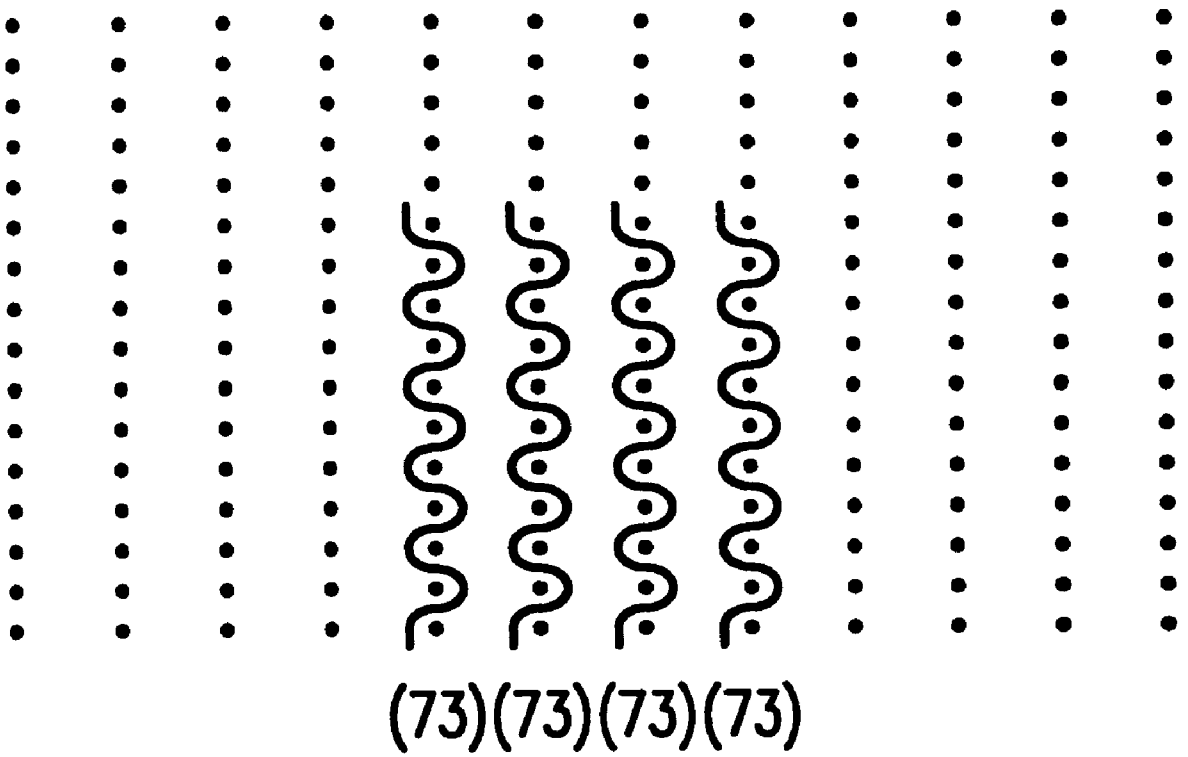
FIG. 6 is an exemplary stitch diagram for a third yarn of an exemplary fabric according to the present invention.
Figure 7:
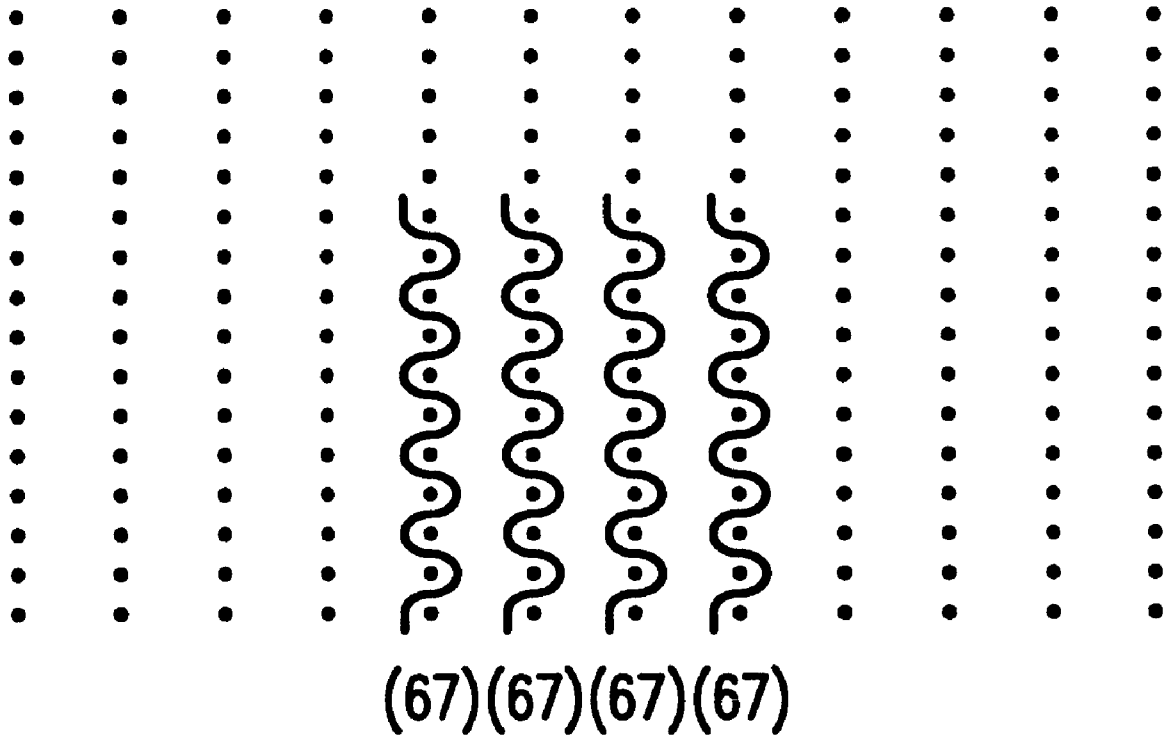
FIG. 7 is an exemplary stitch diagram for a fourth yarn of an exemplary fabric according to the present invention.

FIGS. 4 through 8 illustrate exemplary stitch diagrams for each of these yarns. While any suitable stitch pattern may be employed for each of the yarns, the ground yarn is preferably a fully threaded yarn knitting on each stitch (by the base bar 31 in position (1)), as illustrated in FIG. 4. The laterally laid in yarn or Jacquard yarn is preferably laid in (by a Jacquard bar 33 or other suitable bar at, for example, the (4) position) in any suitable pattern, as shown in FIG. 5, to create a desired effect. As illustrated in FIG. 6, the base elastic yarn, which may be laid in by the first back bar 35 located at position (73), is a fully threaded yarn laid in on each stitch. However, as noted above, the base elastic yarn may be omitted from some needles where appropriate (for example where the pattern elastic yarn forms a straight-line pattern). Likewise, as shown in FIG. 7, the pattern elastic yarn may be laid where appropriate.

Figure 8:
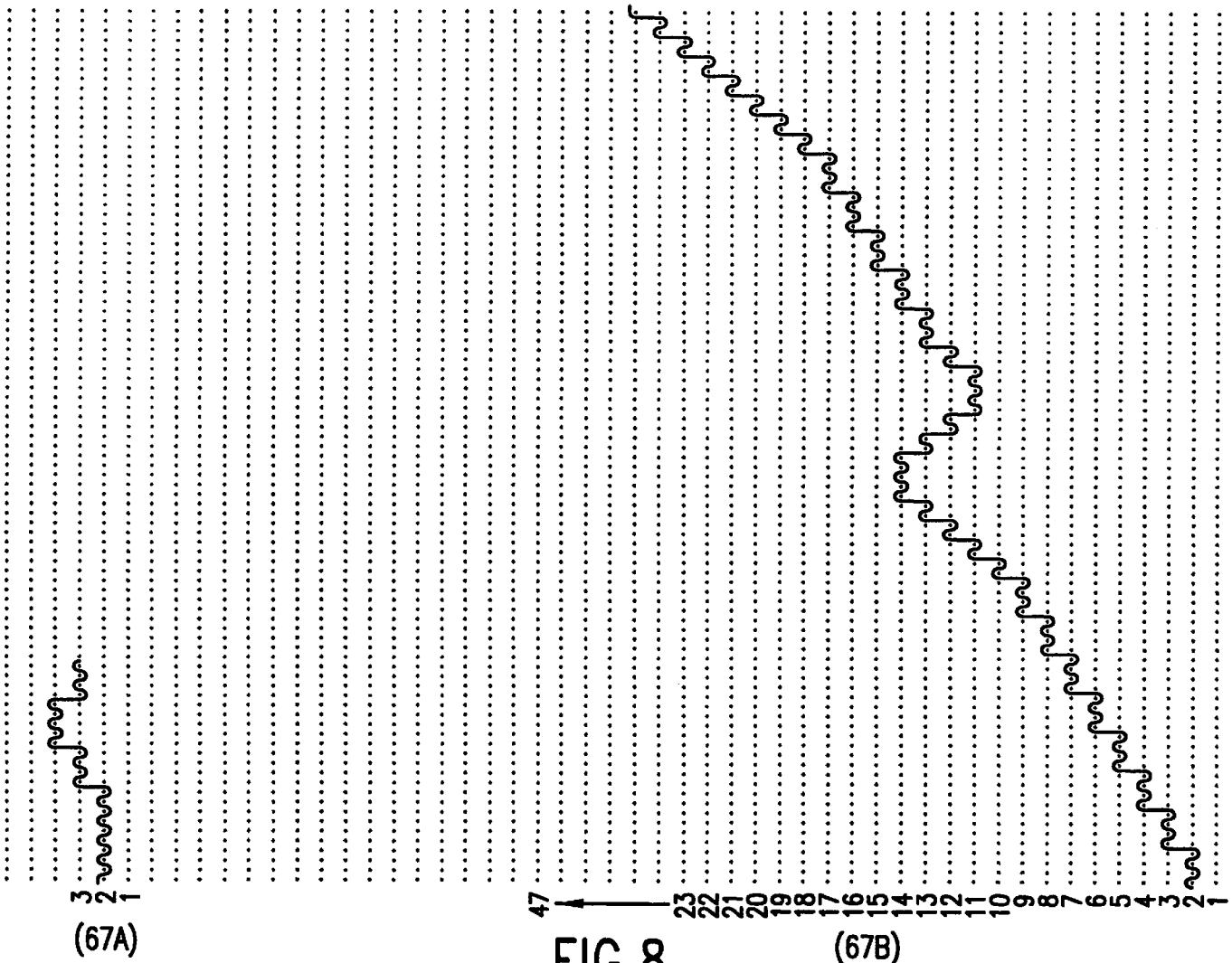
FIG. 8 illustrates additional exemplary stitch diagrams for a fourth yarn of an exemplary fabric according to the present invention.

As noted above, a fabric 20 according to the present invention is preferably formed on a warp knitting machine 30 having a computer-driven second back bar 45, for example at position (67) as shown in FIG. 8. Such a drive system, used in conjunction with a solid bar such as second back bar 45, allows the bar to move laterally across the fabric up to 47 needles. In this manner, a preferred pattern elastomeric zone 23 of a fabric 20 according to the present invention may have relatively large lateral movements within a desired pattern as shown by the stitch pattern labeled (67B) in FIG. 8. In contrast, other systems may be limited to smaller lateral movements, as shown by pattern (67A) of FIG. 8.

A method of forming a knitted elastomeric fabric according to the present invention includes knitting a ground yarn;

laying in a laterally laid in yarn; laying a base elastomeric yarn into the ground yarn, so that the base elastomeric yarn, the laterally laid in yarn and the ground yarn form a base elastomeric fabric; and laying a pattern elastomeric yarn into the ground yarn, so that at least the pattern elastomeric yarn, the laterally laid in yarn, and the ground yarn form a pattern elastomeric zone, wherein the base elastomeric fabric and pattern elastomeric zone have differing elastomeric properties. If desired, the laterally laid in yarn may be a Jacquard yarn into the base yarn, and knitting at least one securing yarn into the base yarn. Preferred fabrics for use with this method are described above. In a preferred embodiment of a method according to the present invention, the fabric is formed on a Rachel warp knitting machine, the warp knitting machine utilizing a first back solid bar to lay in the base elastomeric yarn and a second back bar to lay in the pattern elastomeric yarn. In a particularly preferred embodiment, laying in the pattern elastic yarn may include driving the second back bar using a computerized bar movement system to move the second back bar a lateral distance of at least 10 needles, thereby forming a pattern elastomeric zone including lateral movements of at least 10 needle widths.

The fabric and method according to the present invention have been described with respect to several exemplary embodiments. It can be understood, however, that there are many other variations of the above-described embodiments which will be apparent to those skilled in the art, even where elements have not explicitly been designated as exemplary. For example, other types of yarns may be suitable for use in conjunction with the present invention than those described above. It is understood that this and other modifications are within the teaching of the present invention, which is to be limited only by the claims appended hereto.

What is claimed is:

1. A knitted elastomeric fabric, comprising:

a knitted ground yarn;

a laterally laid in yarn;

a base elastomeric yarn laid into the ground yarn, the base elastomeric yarn, the laterally laid in yarn, and the ground yarn forming a base elastomeric fabric; and a pattern elastomeric yarn laid into the ground yarn, the pattern elastomeric yarn, the base elastomeric yarn, the laterally laid in yarn, and the ground yarn forming a pattern elastomeric zone, wherein the base elastomeric fabric and pattern elastomeric zone have differing elastomeric properties, wherein the pattern elastomeric zone includes lateral movements of at least 10 needle widths.

2. A knitted elastomeric fabric, comprising:

a knitted ground yarn;

a laterally laid in yarn;

a base elastomeric yarn laid into the ground yarn, the base elastomeric yarn, the laterally laid in yarn, and the ground yarn forming a base elastomeric fabric; and a pattern elastomeric yarn laid into the ground yarn, the pattern elastomeric yarn, the base elastomeric yarn, the laterally laid in yarn, and the ground yarn forming a pattern elastomeric zone, wherein the base elastomeric fabric and pattern elastomeric zone have differing elastomeric properties, wherein the ground yarn is a multi-filament synthetic yarn of between approximately 10 and approximately 100 denier, the base elastomeric yarn is a continuous filament elastic yarn of between approximately 100 and approximately 400 denier, and the pattern elastomeric yarn is a continuous filament elastic yarn of at least approximately 100 denier.

3. The knitted elastomeric fabric according to claim 1, wherein the laterally laid in yarn is a Jacquard yarn.

4. A knitted elastomeric fabric, comprising:

a knitted ground yarn;

a laterally laid in yarn;

a base elastomeric yarn laid into the ground yarn, the base elastomeric yarn, the laterally laid in yarn, and the ground yarn forming a base elastomeric fabric; and a pattern elastomeric yarn laid into the ground yarn, the pattern elastomeric yarn, the base elastomeric yarn, the laterally laid in yarn, and the ground yarn forming a pattern elastomeric zone, wherein the base elastomeric fabric and pattern elastomeric zone have differing elastomeric properties wherein the laterally laid in yarn is a Jacquard yarn, wherein the ground yarn is a multi-filament synthetic yarn of between approximately 10 and approximately 100 denier, the base elastomeric yarn is a continuous filament elastic yarn of between approximately 40 and approximately 400 denier, the pattern elastomeric yarn is a continuous filament elastic yarn of at least approximately 100 denier, and the Jacquard yarn is a multi-filament synthetic yarn of between approximately 10 and approximately 100 denier.

5. The knitted elastomeric fabric according to claim 3, further comprising at least one securing yarn knitted into the ground yarn.

6. A knitted elastomeric fabric, comprising:

a knitted ground yarn;

a laterally laid in yarn;

a base elastomeric yarn laid into the ground yarn, the base elastomeric yarn, the laterally laid in yarn, and the ground yarn forming a base elastomeric fabric; and a pattern elastomeric yarn laid into the ground yarn, the pattern elastomeric yarn, the base elastomeric yarn, the laterally laid in yarn, and the ground yarn forming a pattern elastomeric zone, wherein the base elastomeric fabric and pattern elastomeric zone have differing elastomeric properties, wherein the laterally laid in yarn is a Jacquard yarn, further comprising at least one securing yarn knitted into the ground yarn, wherein the ground yarn is a multi-filament synthetic yarn of between approximately 10 and approximately 100 denier, the base elastomeric yarn is a continuous filament elastic yarn of between approximately 40 and approximately 400 denier, the pattern elastomeric yarn is a continuous filament elastic yarn of at least approximately 100 denier, the Jacquard yarn is a multi-filament synthetic yarn of between approximately 10 and approximately 100 denier, and the securing yarn is a synthetic yarn of between approximately 20 and approximately 150 denier.

7. The knitted elastomeric fabric according to claim 5, comprising two of the securing yarns, each of the securing yarns being knitted into the ground yarn.

8. A knitted elastomeric fabric, comprising:

a knitted ground yarn;

a laterally laid in yarn;

a base elastomeric yarn laid into the ground yarn, the base elastomeric yarn, the laterally laid in yarn, and the ground yarn forming a base elastomeric fabric; and a pattern elastomeric yarn laid into the ground yarn, the pattern elastomeric yarn, the base elastomeric yarn, the laterally laid in yarn, and the ground yarn forming a pattern elastomeric zone, wherein the base elastomeric fabric and pattern elastomeric zone have differing elastomeric properties, wherein the laterally laid in yarn is a Jacquard yarn, further comprising at least one securing yarn knitted into the ground yarn, comprising two of the securing yarns, each of the securing yarns being knitted into the ground yarn, wherein the ground yarn is a multi-filament synthetic yarn of between approximately 10 and approximately 100 denier, the base elastomeric yarn is a continuous filament elastic yarn of between approximately 40 and approximately 400 denier, the pattern elastomeric yarn is a continuous filament elastic yarn of at least approximately 100 denier, the Jacquard yarn is a multi-filament synthetic yarn of between approximately 10 and approximately 100 denier, and each of the securing yarns is a synthetic yarn of between approximately 20 and approximately 150 denier.

9. A knitted elastomeric fabric, comprising:

a knitted ground yarn;

a Jacquard yarn laid into the base yarn;

a base elastomeric yarn laid into the ground yarn, the base elastomeric yarn, the Jacquard yarn and the ground yarn forming a base elastomeric fabric; and a pattern elastomeric yarn laid into the ground yarn, the pattern elastomeric yarn, the base elastomeric yarn, the Jacquard yarn and the ground yarn forming a pattern elastomeric zone, wherein the base elastomeric fabric and pattern elastomeric zone have differing elastomeric properties, wherein the pattern elastomeric zone includes lateral movements of at least 10 needle widths.

10. The knitted elastomeric fabric according to claim 9, wherein the fabric is formed on a warp knitting machine having a first back solid bar and a second solid bar, the first back bar laying in the base elastomeric yarn and the second back bar laying in the pattern elastomeric yarn.

11. A knitted elastomeric fabric, comprising:

a knitted ground yarn;

a Jacquard yarn laid into the base yarn;

a base elastomeric yarn laid into the ground yarn, the base elastomeric yarn, the Jacquard yarn and the ground yarn forming a base elastomeric fabric; and a pattern elastomeric yarn laid into the ground yarn, the pattern elastomeric yarn, the base elastomeric yarn, the Jacquard yarn and the ground yarn forming a pattern elastomeric zone, wherein the base elastomeric fabric and pattern elastomeric zone have differing elastomeric properties, wherein the fabric is formed on a warp knitting machine having a first back solid bar and a second back solid bar, the first back solid bar laying in the base elastomeric yarn and the second back solid bar laying in the pattern elastomeric yarn, wherein the ground yarn is a multi-filament synthetic yarn of between approximately 10 and approximately 100 denier, the base elastomeric yarn is a continuous filament elastic yarn of between approximately 40 and approximately 400 denier, the pattern elastomeric yarn is a continuous filament elastic yarn of at least approximately 100 denier, and the Jacquard yarn is a multi-filament synthetic yarn of between approximately 10 and approximately 100 denier.

12. A knitted elastomeric fabric, comprising:

a knitted ground yarn;

a Jacquard yarn laid into the base yarn;

a base elastomeric yarn laid into the ground yarn, the base elastomeric yarn, the Jacquard yarn and the ground yarn forming a base elastomeric fabric; and a pattern elastomeric yarn laid into the ground yarn, the pattern elastomeric yarn, the base elastomeric yarn, the Jacquard yarn and the ground yarn forming a pattern elastomeric zone, wherein the base elastomeric fabric and pattern elastomeric zone have differing elastomeric properties, wherein the fabric is formed on a warp knitting machine having a first back solid bar and a second back solid bar, the first back solid bar laying in the base elastomeric yarn and the second back solid bar laying in the pattern elastomeric yarn, wherein the ground yarn is a multi-filament synthetic yarn of between approximately 10 and approximately 100 denier, the base elastomeric yarn is a continuous filament elastic yarn of between approximately 40 and approximately 400 denier, the pattern elastomeric yarn is a continuous filament elastic yarn of at least approximately 100 denier, and the Jacquard yarn is a multi-filament synthetic yarn of between approximately 10 and approximately 100 denier, further comprising a securing yarn, wherein the securing yarn is knitted into the ground yarn and wherein the securing yarn is a synthetic yarn of between approximately 20 and approximately 150 denier.

13. A knitted elastomeric fabric, comprising:

a knitted ground yarn;

a Jacquard yarn laid into the base yarn;

a base elastomeric yarn laid into the ground yarn, the base elastomeric yarn, the Jacquard yarn and the ground yarn forming a base elastomeric fabric; and a pattern elastomeric yarn laid into the ground yarn, the pattern elastomeric yarn, the base elastomeric yarn, the Jacquard yarn and the ground yarn forming a pattern elastomeric zone, wherein the base elastomeric fabric and pattern elastomeric zone have differing elastomeric properties, wherein the fabric is formed on a warp knitting machine having a first back solid bar and a second back solid bar, the first back solid bar laying in the base elastomeric yarn and the second back solid bar laying in the pattern elastomeric yarn, wherein the ground yarn is a multi-filament synthetic yarn of between approximately 10 and approximately 100 denier, the base elastomeric yarn is a continuous filament elastic yarn of between approximately 40 and approximately 400 denier, the pattern elastomeric yarn is a continuous filament elastic yarn of at least approximately 100 denier, and the Jacquard yarn is a multi-filament synthetic yarn of between approximately 10 and approximately 100 denier, further comprising a securing yarn, wherein the securing yarn is knitted into the ground yarn and wherein the securing yarn is a synthetic yarn of between approximately 20 and approximately 150 denier, wherein the ground yarn is a multi-filament synthetic yarn of between approximately 30 and approximately 50 denier and having between approximately 10 and approximately 50 filaments, the base elastomeric yarn is a continuous filament elastic yarn of between approximately 120 and approximately 160 denier, the pattern elastomeric yarn is a continuous filament elastic yarn of at least approximately 120 denier, the Jacquard yarn is a multi-filament synthetic yarn of between approximately 30 and approximately 50 denier and having between approximately 10 and approximately 50 filaments, and the securing yarn is a synthetic yarn of between approximately 40 and approximately 60 denier.

14. A method of forming a knitted elastomeric fabric, comprising:

knitting a ground yarn;

laying in a laterally laid in yarn;

laying a base elastomeric yarn into the ground yarn, the base elastomeric yarn, the laterally laid in yarn and the ground yarn forming a base elastomeric fabric, and laying a pattern elastomeric yarn into the ground yarn, at least the pattern elastomeric yarn, the laterally laid in yarn, and the ground yarn forming a pattern elastomeric zone, wherein the base elastomeric fabric and pattern elastomeric zone have differing elastomeric properties, wherein the fabric is formed on a Rachel warp knitting machine, the warp knitting machine utilizing a first back solid bar to lay in the base elastomeric yarn and a second back solid bar to lay in the pattern elastomeric yarn, wherein laying in the pattern elastic yarn includes driving the second back bar using a computerized bar movement system to move the second back bar a lateral distance of at least 10 needles.

15. The method according to claim 14, wherein the laterally laid in yarn is a Jacquard yarn.

16. The method according to claim 15, further comprising:

knitting at least one securing yarn into the base yarn.

17. A method of forming a knitted elastomeric fabric, comprising:

knitting a ground yarn;

laying in a laterally laid in yarn;

laying a base elastomeric yarn into the ground yarn, the base elastomeric yarn, the laterally laid in yarn and the ground yarn forming a base elastomeric fabric; and laying a pattern elastomeric yarn into the ground yarn, at least the pattern elastomeric yarn, the laterally laid in yarn, and the ground yarn forming a pattern elastomeric zone, wherein the base elastomeric fabric and pattern elastomeric zone have differing elastomeric properties, wherein the laterally laid in yarn is a Jacquard yarn, wherein the ground yarn is a multi-filament synthetic yarn of between approximately 10 and approximately 100 denier, the base elastomeric yarn is a continuous filament elastic yarn of between approximately 40 and approximately 400 denier, the pattern elastomeric yarn is a continuous filament elastic yarn of at least approximately 100 denier, and the Jacquard yarn is a multi-filament synthetic yarn of between approximately 10 and approximately 100 denier.

18. A method of forming a knitted elastomeric fabric, comprising:

knitting a ground yarn;

laying in a laterally laid in yarn;

laying a base elastomeric yarn into the ground yarn, the base elastomeric yarn, the laterally laid in yarn and the ground yarn forming a base elastomeric fabric; and laying a pattern elastomeric yarn into the ground yarn, at least the pattern elastomeric yarn, the laterally laid in yarn, and the ground yarn forming a pattern elastomeric zone, wherein the base elastomeric fabric and pattern elastomeric zone have differing elastomeric properties, wherein the laterally laid in yarn is a Jacquard yarn, wherein the ground yarn is a multi-filament synthetic yarn of between approximately 10 and approximately 100 denier, the base elastomeric yarn is a continuous filament elastic yarn of between approximately 40 and approximately 400 denier, the pattern elastomeric yarn is a continuous filament elastic yarn of at least approximately 100 denier, and the Jacquard yarn is a multi-filament synthetic yarn of between approximately 10 and approximately 100 denier, wherein the ground yarn is a multi-filament synthetic yarn of between approximately 30 and approximately 50 denier and having between approximately 10 and approximately 50 filaments, the base elastomeric yarn is a continuous filament elastic yarn of between approximately 120 and approximately 160 denier, the pattern elastomeric yarn is a continuous filament elastic yarn of at least approximately 120 denier, and the Jacquard yarn is a multi-filament synthetic yarn of between approximately 30 and approximately 50 denier and having between approximately 10 and approximately 50 filaments.

19. The method according to claim 14, wherein the fabric is formed on a Rachel warp knitting machine, the warp knitting machine utilizing a first back solid bar to lay in the base elastomeric yarn and a second back solid bar to lay in the pattern elastomeric yarn.

20. The method according to claim 19, wherein laying in the pattern elastic yarn includes driving the second back bar using a computerized bar movement system to move the second back bar a lateral distance of at least 10 needles.

21. A knitted elastomeric fabric, comprising:

a ground yarn;

a laterally laid in yarn;

a base elastomeric yarn laid into the ground yarn, the base elastomeric yarn, the laterally laid in yarn, and the ground yarn forming a base elastomeric fabric; and a pattern elastomeric yarn laid into the ground yarn, the pattern elastomeric yarn, the laterally laid in yarn, and the ground yarn forming a pattern elastomeric zone, wherein the base elastomeric fabric and pattern elastomeric zone have differing elastomeric properties, wherein the pattern elastomeric zone includes lateral movements of at least 10 needle widths.

22. A knitted elastomeric fabric, comprising:

a ground yarn;

a laterally laid in yarn;

a base elastomeric yarn laid into the ground yarn, the base elastomeric yarn, the laterally laid in yarn, and the ground yarn forming a base elastomeric fabric; and a pattern elastomeric yarn laid into the ground yarn, the pattern elastomeric yarn, the laterally laid in yarn, and the ground yarn forming a pattern elastomeric zone, wherein the base elastomeric fabric and pattern elastomeric zone have differing elastomeric properties, wherein the ground yarn is a multi-filament synthetic yarn of between approximately 10 and approximately 100 denier, the base elastomeric yarn is a continuous filament elastic yarn of between approximately 40 and approximately 400 denier, and the pattern elastomeric yarn is a continuous filament elastic yarn of at least approximately 100 denier.

23. The knitted elastomeric fabric according to claim 21, wherein the laterally laid in yarn is a Jacquard yarn.

24. A knitted elastomeric fabric, comprising:

a ground yarn;

a laterally laid in yarn;

a base elastomeric yarn laid into the ground yarn, the base elastomeric yarn, the laterally laid in yarn, and the ground yarn forming a base elastomeric fabric; and a pattern elastomeric yarn laid into the ground yarn, the pattern elastomeric yarn, the laterally laid in yarn, and the ground yarn forming a pattern elastomeric zone, wherein the base elastomeric fabric and pattern elastomeric zone have differing elastomeric properties, wherein the laterally laid in yarn is a Jacquard yarn, wherein the ground yarn is a multi-filament synthetic yarn of between approximately 10 and approximately 100 denier, the base elastomeric yarn is a continuous filament elastic yarn of between approximately 40 and approximately 400 denier, the pattern elastomeric yarn is a continuous filament elastic yarn of at least approximately 100 denier, and the Jacquard yarn is a multi-filament synthetic yarn of between approximately 10 and approximately 100 denier.

25. The knitted elastomeric fabric according to claim 21, further comprising at least one securing yarn knitted into the ground yarn.

26. A knitted elastomeric fabric, comprising:

a ground yarn;

a laterally laid in yarn;

a base elastomeric yarn laid into the ground yarn, the base elastomeric yarn, the laterally laid in yarn, and the ground yarn forming a base elastomeric fabric; and a pattern elastomeric yarn laid into the ground yarn, the pattern elastomeric yarn, the laterally laid in yarn, and the ground yarn forming a pattern elastomeric zone, wherein the base elastomeric fabric and pattern elastomeric zone have differing elastomeric properties, further comprising at least one securing yarn knitted into the ground yarn, wherein the ground yarn is a multi-filament synthetic yarn of between approximately 10 and approximately 100 denier, the base elastomeric yarn is a continuous filament elastic yarn of between approximately 40 and approximately 400 denier, the pattern elastomeric yarn is a continuous filament elastic yarn of at least approximately 100 denier, the Jacquard yarn is a multi-filament synthetic yarn of between approximately 10 and approximately 100 denier, and the securing yarn is a synthetic yarn of between approximately 20 and approximately 150 denier.

27. The knitted elastomeric fabric according to claim 25, comprising two of the securing yarns, each of the securing yarns being knitted into the ground yarn.

28. A knitted elastomeric fabric, comprising:

a ground yarn;

a laterally laid in yarn;

a base elastomeric yarn laid into the ground yarn, the base elastomeric yarn, the laterally laid in yarn, and the ground yarn forming a base elastomeric fabric; and a pattern elastomeric yarn laid into the ground yarn, the pattern elastomeric yarn, the laterally laid in yarn, and the ground yarn forming a pattern elastomeric zone, wherein the base elastomeric fabric and pattern elastomeric zone have differing elastomeric properties, further comprising at least one securing yarn knitted into the ground yarn, further comprising two of the securing yarns, each of the securing yarns being knitted into the ground yarn, wherein the ground yarn is a multi-filament synthetic yarn of between approximately 10 and approximately 100 denier, the base elastomeric yarn is a continuous filament elastic yarn of between approximately 40 and approximately 400 denier, the pattern elastomeric yarn is a continuous filament elastic yarn of at least approximately 100 denier, the Jacquard yarn is a multi-filament synthetic yarn of between approximately 10 and approximately 100 denier, and each of the securing yarns is a synthetic yarn of between approximately 20 and approximately 150 denier.

* * * * *